US009090096B2

(12) United States Patent
Guan et al.

(10) Patent No.: US 9,090,096 B2
(45) Date of Patent: Jul. 28, 2015

(54) PRINTER AND RECORDING MEDIUM

(71) Applicant: Brother Kogyo Kabushiki Kaisha, Nagoya-shi, Aichi-ken (JP)

(72) Inventors: Shanshan Guan, Nagoya (JP); Tomoki Miyashita, Nagoya (JP); Keigo Kako, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/337,827

(22) Filed: Jul. 22, 2014

(65) Prior Publication Data

US 2015/0022614 A1 Jan. 22, 2015

(30) Foreign Application Priority Data

Jul. 22, 2013 (JP) ..... 2013-152007

(51) Int. Cl.
*B41J 2/325* (2006.01)
*B41J 2/525* (2006.01)

(52) U.S. Cl.
CPC ..... *B41J 2/525* (2013.01)

(58) Field of Classification Search
USPC ..... 347/171–174, 178, 214, 215, 217, 218; 400/120.01, 120.02, 237
See application file for complete search history.

(56) References Cited

U.S. PATENT DOCUMENTS

| | | | | |
|---|---|---|---|---|
| 5,739,839 | A * | 4/1998 | Iwai et al. | 347/214 |
| 6,371,670 | B1 * | 4/2002 | Kojo | 400/120.01 |
| 8,115,791 | B2 * | 2/2012 | Vandermeulen et al. | 347/214 |
| 8,967,892 | B2 * | 3/2015 | Ishii et al. | 347/214 |
| 2009/0046136 | A1 * | 2/2009 | Choi et al. | 347/214 |
| 2012/0044314 | A1 * | 2/2012 | Higuchi et al. | 347/214 |

FOREIGN PATENT DOCUMENTS

| | | | |
|---|---|---|---|
| JP | H09-234934 | A | 9/1997 |
| JP | 2012-073700 | A | 4/2012 |
| JP | 2013-018141 | A | 1/2013 |

* cited by examiner

*Primary Examiner* — Kristal Feggins
(74) *Attorney, Agent, or Firm* — Banner & Witcoff, Ltd.

(57) ABSTRACT

The disclosure discloses a printer including a housing, a cartridge holder, a display device, a color detecting portion, and a control portion. The cartridge holder removably mounts a tape cartridge including a print-receiving tape roll and an ink ribbon roll. The display device displays desired content in monochrome. The color detection portion detects first color information representing a color of a print-receiving tape and second color information representing a color of an ink ribbon, in the tape cartridge mounted in the cartridge holder. The control portion controls the display device at appropriate timing with an opening and closing cover closed, to display in text the first color information and the second color information detected by the color detection portion.

8 Claims, 14 Drawing Sheets

FIG. 7

| SENSOR S1 | SENSOR S2 | SENSOR S3 | SENSOR S4 | SENSOR S5 | TAPE COLOR INFORMATION | INK COLOR INFORMATION | TAPE TYPE |
|---|---|---|---|---|---|---|---|
| 1 (HOLE) | 0 (NO HOLE) | 0 (NO HOLE) | 0 (NO HOLE) | 1 (HOLE) | WHITE | BLACK | TYPE A |
| 1 (HOLE) | 0 (NO HOLE) | 1 (HOLE) | 0 (NO HOLE) | 1 (HOLE) | BLACK | WHITE | TYPE B |
| 0 (NO HOLE) | 0 (NO HOLE) | 0 (NO HOLE) | 1 (HOLE) | 0 (NO HOLE) | WHITE | RED | TYPE C |
| 0 (NO HOLE) | 1 (HOLE) | 0 (NO HOLE) | 1 (HOLE) | 1 (HOLE) | YELLOW | BLACK | TYPE D |
| ... | ... | ... | ... | ... | ... | ... | ... |

PRINTER AND RECORDING MEDIUM

CROSS-REFERENCE TO RELATED APPLICATION

The present application claims priority from Japanese Patent Application No. 2013-152007, which was filed on Jul. 22, 2013, the disclosure of which is incorporated herein by reference in its entirety.

BACKGROUND

1. Field

The present disclosure relates to a printer performing desired print on a print-receiving tape and a recording medium storing a control program used in the printer.

2. Description of the Related Art

A printer has been already known which performs desired print on a print-receiving tape. The printer (print label producing apparatus) of a prior art includes a cartridge holder and a thermal head in a housing. An opening and closing cover is opened to mount a tape cartridge to the cartridge holder, and then the opening and closing cover is closed to feed out the print-receiving tape (cover film) from a print-receiving tape roll (second roll) in the tape cartridge. Ink of an ink ribbon fed out from the ink ribbon roll in the tape cartridge is transferred onto the print-receiving tape by the thermal head. With this operation, desired print data is formed on the print-receiving tape to create the printed matter (print label).

With the printer, an operator can create various types of printed matter by exchanging various types of the above described tape cartridges for use. When the tape cartridge is mounted to the cartridge holder, predetermined detection means detects dimensional information (e.g., width information and length information) about the print-receiving tape of the tape cartridge. The detected dimensional information is displayed in a text on display means (display portion) with an image of the print label to be created using the print-receiving tape.

As described above, when the various types of the tape cartridges are exchanged for use, combinations of colors of the print-receiving tape and the ink ribbon may be changed variously to create the printed matter having various colors. However, according to the above described prior art, since only the dimensional information about the print-receiving tape is displayed, the operator cannot recognize the color of the above described print-receiving tape and that of the ink ribbon in advance before the printed matter is produced. As a result, the printed matter in an unintended color mode may be erroneously produced, thereby causing inconvenience.

SUMMARY

An object of the present disclosure is to provide a printer capable of preventing the printed matter in the unintended color mode from being erroneously produced to improve the convenience of the operator, and a recording medium storing a computer program used in the printer.

In order to achieve the above-described object, according to the aspect of the present application, there is provided a printer comprising a housing forming an apparatus outer enclosure, a cartridge holder disposed inside the housing and configured to removably mount a tape cartridge including a print-receiving tape roll feeding out a print-receiving tape and an ink ribbon roll feeding out an ink ribbon, a display device disposed on the housing and configured to display a desired content in monochrome, an opening and closing cover disposed on the housing and configured to open and close the cartridge holder, a thermal head configured to form print data by transferring ink of the ink ribbon fed out from the ink ribbon roll to the print-receiving tape fed out from the print-receiving tape roll of the tape cartridge mounted in the cartridge holder, to create printed matter, a color detection portion configured to detect first color information representing a color of the print-receiving tape and second color information representing a color of the ink ribbon, in the tape cartridge mounted in the cartridge holder, and a control portion configured to control the display device at appropriate timing with the opening and closing cover closed, to display in text the first color information and the second color information detected by the color detection portion.

BRIEF DESCRIPTION OF THE DRAWING

FIG. 7 is a table illustrating an example of cartridge correlation stored in an EEPROM of a control circuit.

DETAILED DESCRIPTION OF THE PREFERRED EMBODIMENTS

With reference to diagrams, an embodiment according to the present disclosure will be described below. In following descriptions, when "up", "down", "front", "back", and "width" are described about a label producing apparatus 1, each of them corresponds to an arrow direction appropriately indicated in diagrams such as FIG. 1, and when "thickness" is described about the label producing apparatus 1, the thickness in a front and back direction is indicated.

Entire Configuration of Label Producing Apparatus

Figure 1:
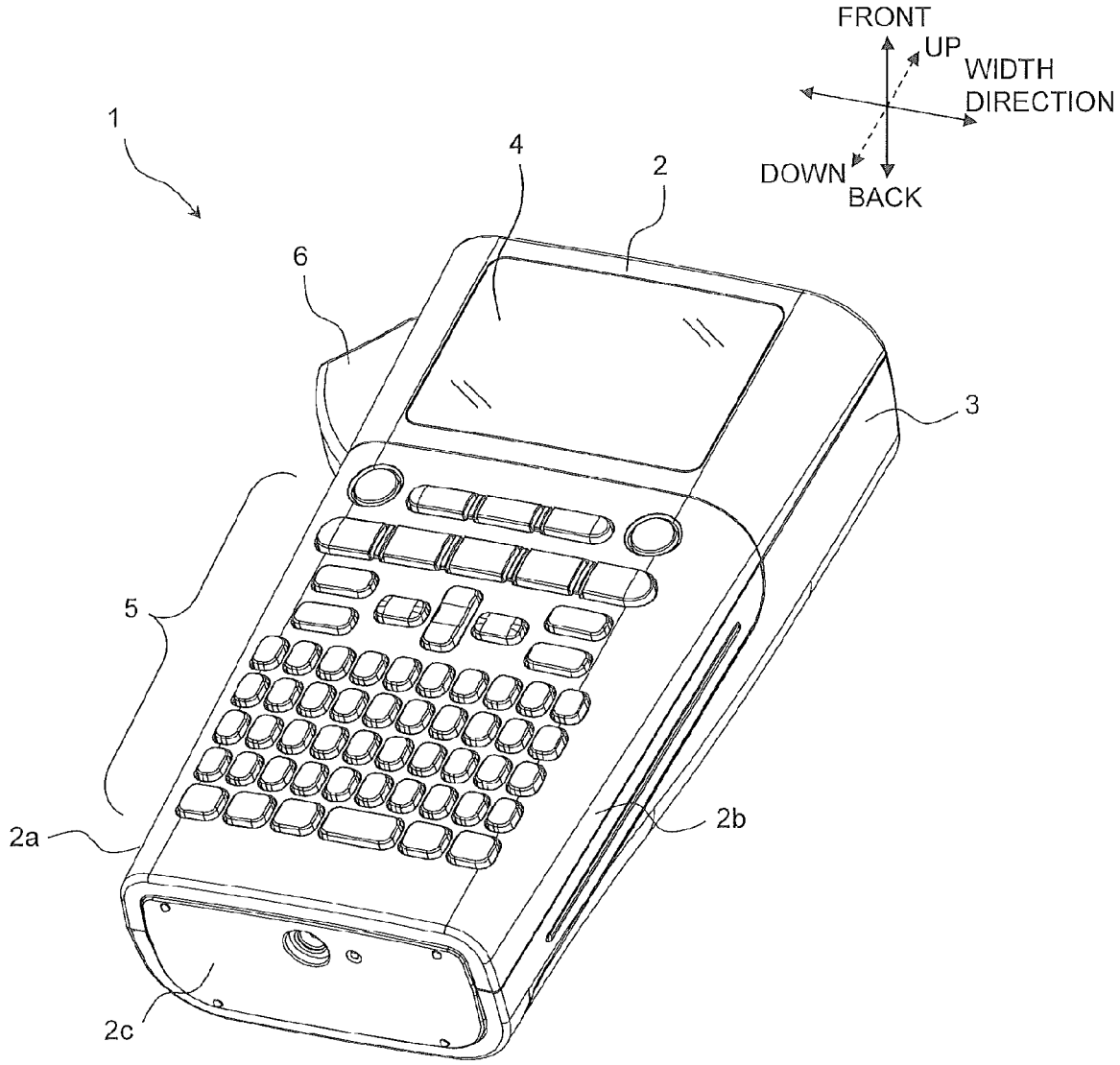
FIG. 1 is a perspective view illustrating an outer appearance of a front side of a label producing apparatus according to a first embodiment of the present disclosure.
Figure 2:
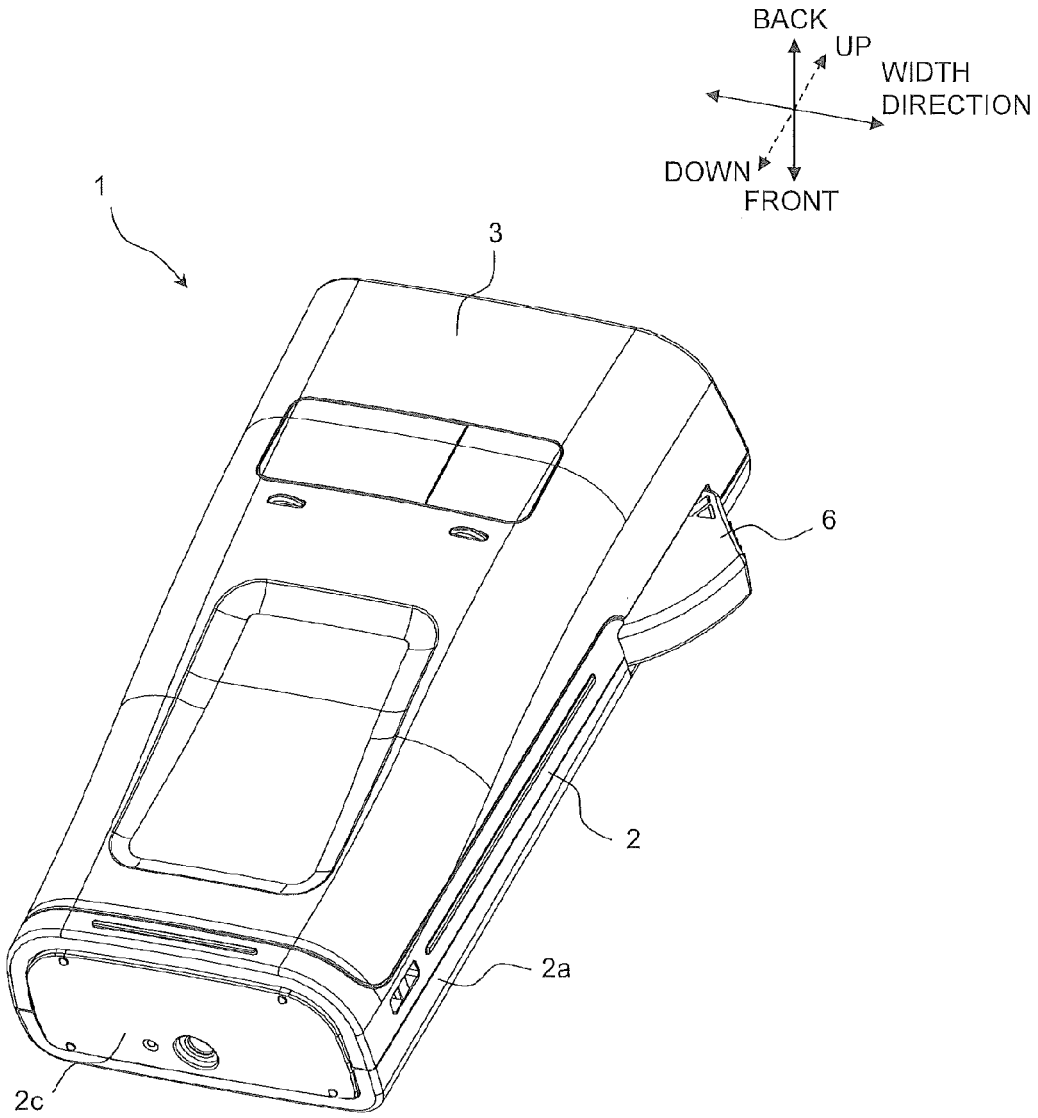
FIG. 2 is a perspective view illustrating an outer appearance of a back side of the label producing apparatus according to the first embodiment of the present disclosure.

As illustrated in FIGS. 1 and 2, the label producing apparatus 1 (corresponding to a printer) is electronic equipment of a hand-held type that can be held by an operator's hand. The label producing apparatus 1 includes an apparatus main body 2 (corresponding to a housing) forming an apparatus outer enclosure and a cover 3 (corresponding to an opening and closing cover) that can be removably attached on a surface of a back portion of the apparatus main body 2, and can open and close a cartridge holder 12 described below.

The apparatus main body 2 has a flat and substantially cuboid shape that is thin and long in a vertical direction. A liquid crystal display unit 4 (corresponding to a display device) for displaying print data, a setting screen and the like in monochrome is disposed on an upper portion of a front face of the apparatus main body 2 and, beneath the liquid crystal display unit 4, a keyboard unit 5 (corresponding to an operation device) for operating the label producing apparatus 1 is disposed. In the keyboard unit 5, a group of keys including character keys such as characters, symbols, and numbers, and various types of function keys are disposed. Further, on an upper portion of a side wall portion 2*a* on one side of the apparatus main body 2 in a width direction (a left side in FIG. 1 and a right side in FIG. 2), a cutting operation lever 6 for cutting a label tape with print (described below) is disposed.

Cover Configuration

Figure 3:
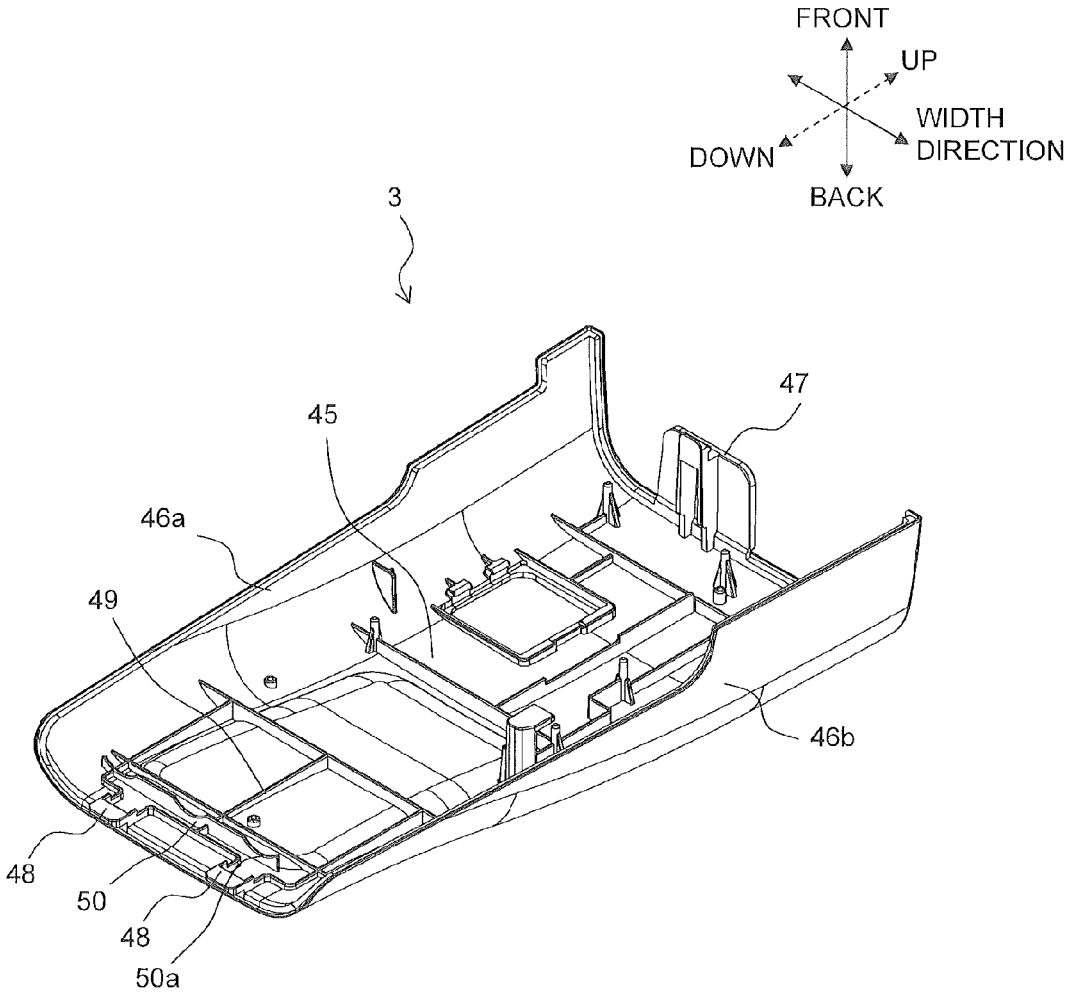
FIG. 3 is a perspective view illustrating a configuration of an inside of a cover.

FIG. 3 illustrates a configuration of an inside of the cover 3. As illustrated in FIG. 3, the cover 3 includes a bottom portion 45, a side face portion 46*a* erected at one side in the width direction of the bottom portion 45 (an upper-left side in FIG. 3), and a side face portion 46*b* erected at the other side in the width direction (a lower-right side in FIG. 3). The cover 3 is formed in a substantially U-shape when viewed from a side face in the up and down direction. At an upper edge portion of the bottom portion 45, a protruding piece 47 erected in a thickness direction of the apparatus main body 2 from a substantially center portion is formed. The side face portion 46*a* at the one side in the width direction is formed in a step shape in which height of the side face portion 46*a* in an erected direction (same as a front and back direction) is gradually decreased in three steps from the upper edge portion to a lower edge portion. In a similar manner, the side face portion 46*b* at the other side in the width direction is formed in the step shape in which the height of the side face portion 46*b* in the erected direction is gradually decreased in two steps from the upper edge portion to the lower edge portion.

At a lower edge of the bottom portion 45 of the cover 3, an insertion piece 48, which is inserted into an engagement hole 2*c*1 (refer to FIG. 4 described below) disposed on two points in a width direction of the lower portion 2C of the apparatus main body 2, is disposed on two points in the width direction, when the cover 3 is mounted onto a back face portion of the apparatus main body 2.

Further, on a lower portion of the bottom portion 45 of the cover 3, there are erected a first rib 49 in a rectangular frame shape assembled in the width direction and the up and down direction of the apparatus main body 2, and a second rib 50 that is disposed on a further downside of and close to the apparatus main body 2 and has a cutout 50*a* in a circular-arc shape at three points in the width direction. Heights of the ribs 49, 50 are set such that the height of the upper edge of the first rib 49 in the erected direction and the height of the circular-arc center portion of the cutout 50*a* of the second rib 50 in the erected direction are substantially the same.

The first rib 49 is abut and pressed onto a surface of a rechargeable battery when the rechargeable battery (not illustrated) is stored in a battery storage unit 30 (refer to FIGS. 4, 5 described below) and the cover 3 is mounted onto the back face portion of the apparatus main body 2.

To mount the cover 3 onto the back face portion of the apparatus main body 2, the two insertion pieces 48 at the lower edge of the cover 3 are inserted into the two engagement holes 2*c*1 at the lower portion 2*c* of the apparatus main body 2, and the protruding piece 47 at the upper edge of the cover 3 is inserted into and engaged with an engagement opening portion 9 (refer to FIG. 4 described below) at the upper edge of the apparatus main body 2. With this arrangement, the cover 3 is mounted onto the back face portion of the apparatus main body 2, and thus the cover 3 covers a label production unit 10 (including the cartridge holder 12) and the battery storage unit 30 of the apparatus main body 2 (refer to FIG. 4 described below).

Label Production Mechanism of Label Producing Apparatus

Figure 4:
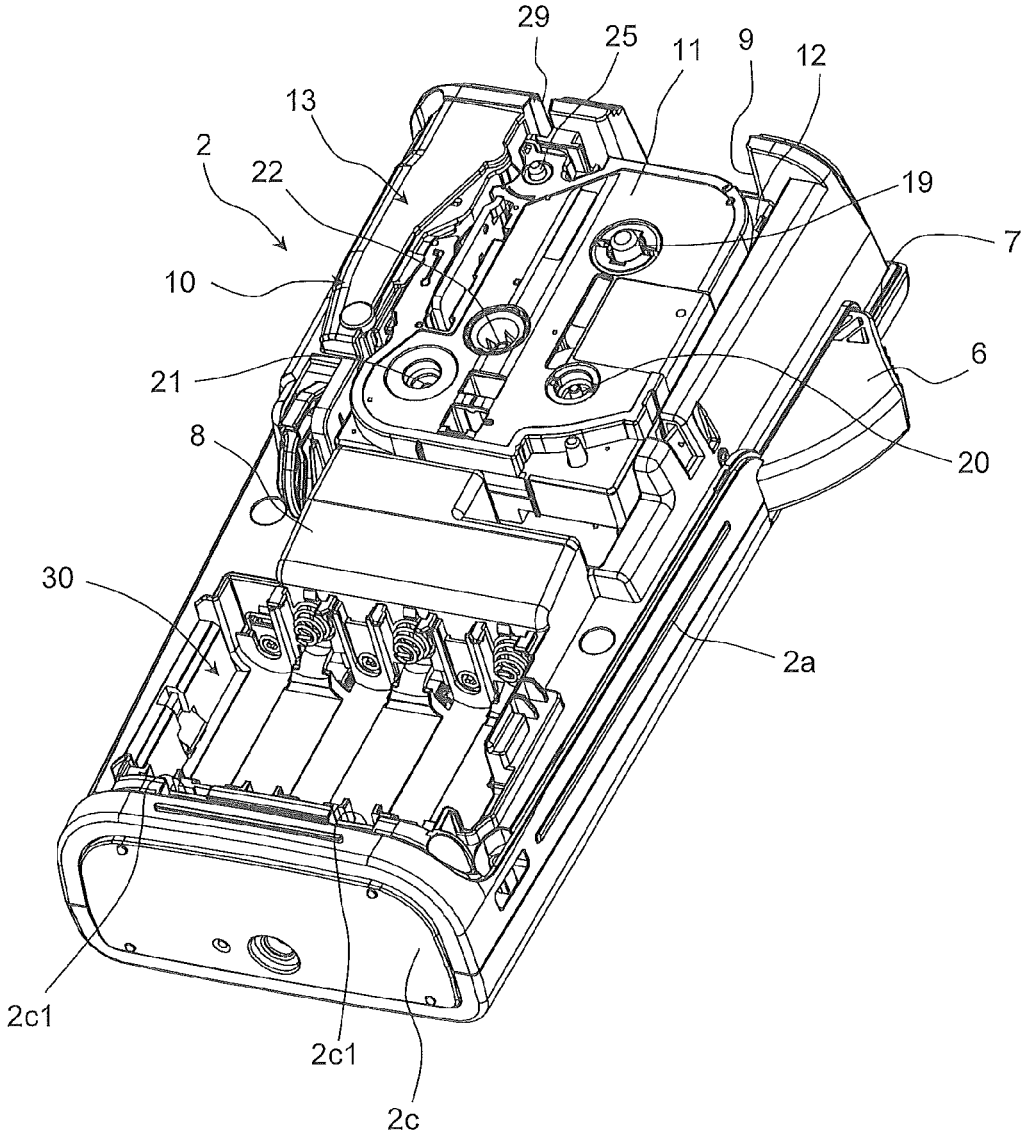
FIG. 4 is a perspective view illustrating an inside configuration of the back side of an apparatus main body when batteries are not stored.
Figure 5:
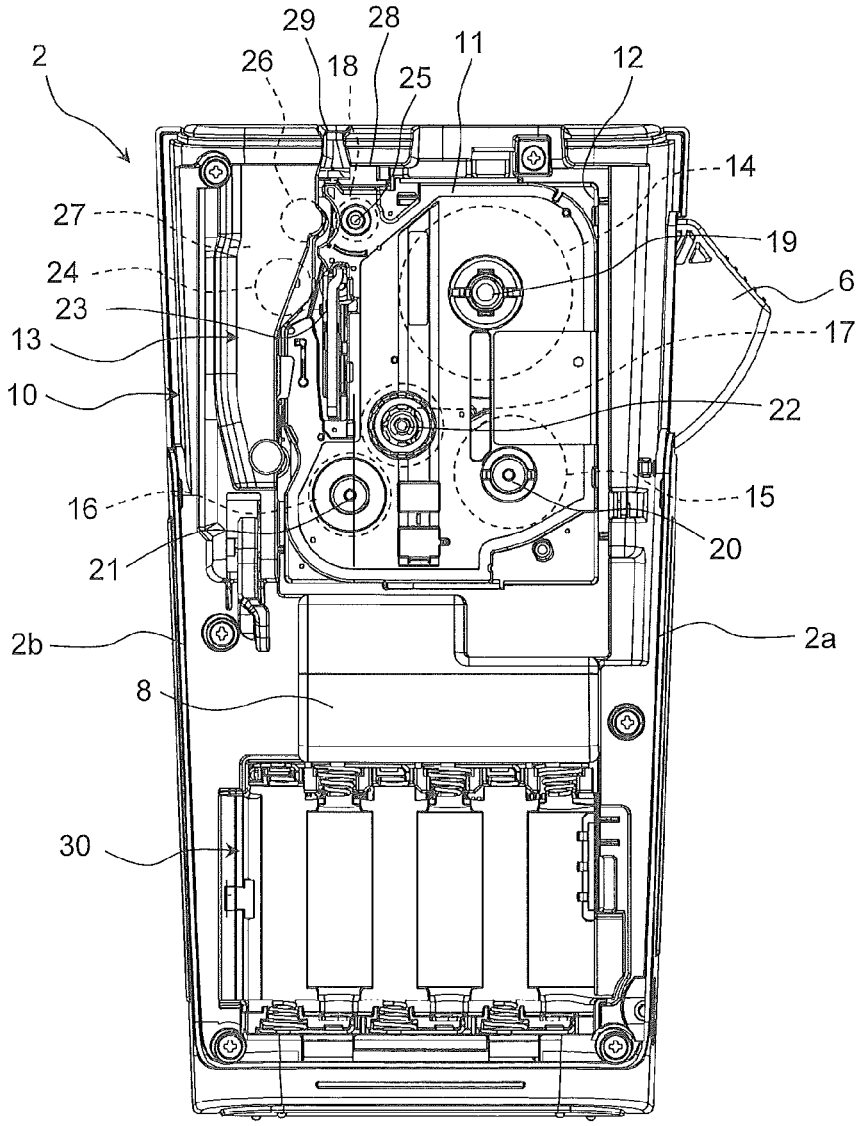
FIG. 5 is a plan view illustrating the inside configuration of the back side of the apparatus main body when the batteries are not stored.

As illustrated in FIGS. 4, 5, the apparatus main body 2 includes the label production unit 10 and the battery storage unit 30. The label production unit 10 and the battery storage unit 30 are segmented by a storage unit 8 storing a control substrate (not illustrated) and a motor 63*a* (refer to FIG. 6 described below) for driving a platen roller 24 described below. Further, as illustrated in FIGS. 4, 5, on side wall portions 2*a*, 2*b* at the one side and the other side in the above described width direction of the apparatus main body 2, step portions 7 each having a shape corresponding to an edge portion of an opening side of the cover 3 are disposed. On the upper edge of the apparatus main body 2, the engagement opening portion 9 is disposed.

The label production unit 10 includes a cartridge holder 12 in a recessed shape for removably mounting a cartridge 11 disposed in a substantially most part of an upper half portion of the apparatus main body 2, and a printing and feeding mechanism 13 disposed on a region including the other side (left side in FIGS. 4, 5) of the cartridge holder 12 in the width direction. As illustrated in FIG. 5, the cartridge 11 includes therein a base tape roll 14, a cover-film roll 15 (corresponding to the print-receiving tape), an ink-ribbon roll 16, an ink-ribbon take-up roller 17, and a feeding roller 18.

The printing and feeding mechanism 13 includes a support axis 19 of the base tape roll 14, a support axis 20 of the cover-film roll 15, a support axis 21 of the ink-ribbon roll 16, an ink-ribbon take-up axis 22, a thermal head 23, a platen roller 24, a drive axis 25 of the feeding roller 18, and a pressing roller 26. The platen roller 24 and the pressing roller 26 are mounted to the roll holder 27, and can be switched, by a sliding movement of the roll holder 27, between the printing and feeding position (position illustrated in FIG. 5) to contact the thermal head 23 and the feeding roller 18 respectively and a waiting position (not illustrated) to be separated from the thermal head 23 and the feeding roller 18.

When a print label is produced, the platen roller 24 and the pressing roller 26 are switched to the printing and feeding position. The platen roller 24 switched to the printing and feeding position is rotated by driving of the motor 63*a* at a side of the apparatus main body 2, and a cover film (corresponding to a print-receiving tape, not illustrated) fed out from the cover-film roll 15 and the ink ribbon (not illustrated) fed out from the ink-ribbon roll 16 are pressed onto the thermal head 23. With this arrangement, the thermal head 23 performs desired print according to print data on the cover film, and the platen roller 24 feeds the cover film and the ink ribbon that have finished print to the feeding roller 18. The ink ribbon that has finished the print is subsequently separated from the cover film and taken up by the ink-ribbon take-up roller 17.

On the other hand, the pressing roller 26 switched to the printing and feeding position presses the cover film that is fed by the platen roller 24 and has finished the print and a base tape (not illustrated) fed out from the base tape roll 14 onto the feeding roller 18 rotated by the driving of the drive axis 25 connected to the motor 63*a* (refer to FIG. 6 described below). With this arrangement, while the cover film that has finished the print and the base tape are bonded to each other to form the label tape with print, the feeding roller 18 feeds the label tape with print to a label discharging exit 29 disposed on the upper edge of the apparatus main body 2. At a predetermined time point, when the label tape with print is discharged via the label discharging exit 29, the operator manually operates the cutting operation lever 6 so that a cutter 28 disposed close to the label discharging exit 29 acts to cut the label tape with print to form print labels L1, L2, and the subsequent print labels in a desired length (corresponding to the printed matter).

The battery storage unit 30 is formed as a long recessed portion in a substantially rectangular shape in the width direction of the apparatus main body 2 in a planar view, and a plurality of (according to this example, six) batteries in a cylindrical shape (not illustrated) or one rechargeable battery (e.g., lithium ion battery pack, not illustrated) in a cuboid shape can be selectively stored.

Control System of Label Producing Apparatus

Figure 6:
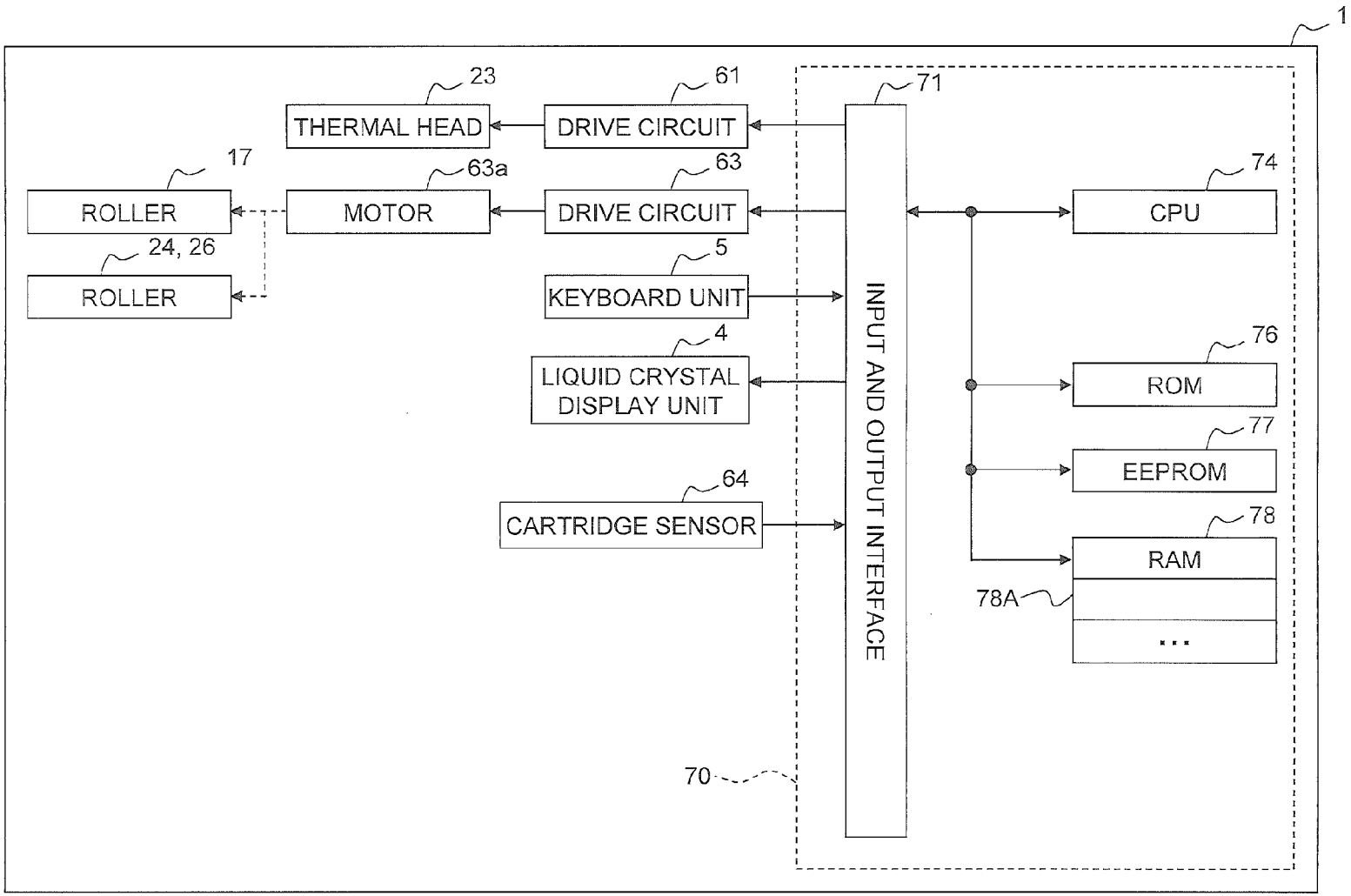
FIG. 6 is a functional block diagram illustrating a control system of the label producing apparatus.

With reference to FIG. 6, a control system of the label producing apparatus 1 will be described below.

As illustrated in FIG. 6, a control circuit 70 is disposed on a control substrate (not illustrated) of the label producing apparatus 1. The control circuit 70 includes a CPU 74, and the CPU 74 is connected with a ROM 76, a RAM 78, an EEPROM 77, and an input and output interface 71 via a data bus. In place of the EEPROM 77, a non-volatile memory such as a flash memory may be used.

The ROM 76 stores various types of programs (e.g., control program for performing each step of the flows illustrated in FIGS. 9, 10, 12 described below) required by the label producing apparatus 1 to execute control. The CPU 74 executes various types of computing based on various types of programs stored in the ROM 76.

The RAM 78 temporally stores various types of computing results executed by the CPU 74. The RAM 78 includes a label image memory 78A and the like.

The EEPROM 77 stores various types of information such as cartridge correlation described below. The EEPROM 77 corresponds to a memory according to each claim.

The input and output interface 71 is connected with a thermal head driving circuit 61, a motor driving circuit 63, the above described keyboard unit 5, the above described liquid crystal display unit 4, and a cartridge sensor 64 and the like.

The thermal head driving circuit 61 drives the above described thermal head 23.

The motor driving circuit 63 drives the above described motor 63*a* to rotate the above described ink-ribbon take-up roller 17 via a gear (not illustrated). Further, rotation of the gear is transmitted to a platen roller gear and a pressing roller gear (not illustrated). When the platen roller gear and the pressing roller gear are rotated, the above described platen roller 24 and the pressing roller 26 are rotated accordingly.

In the control system centering on such a control circuit 70, when the operator inputs a predetermined label production instruction via the keyboard unit 5, the platen roller 24 and the pressing roller 26 and the like are driven via the motor driving circuit 63 and the motor 63*a* to feed the cover film or the like. Further, in synchronization with the above described operation, a plurality of heating elements of the thermal head 23 is selectively heated and driven via the thermal head driving circuit 61 to perform the print of the print object on the above described cover film being fed. With this arrangement, finally, the print labels with the print object formed on the cover film are produced.

Further, the cartridge 11 includes a portion to be detected (not illustrated) that is, when the cartridge 11 is mounted into the cartridge holder 12, to be detected by the cartridge sensor 64 (illustrated only in FIG. 6) and disposed on the apparatus main body 2. The cartridge sensor 64 detects the above described portion to be detected appropriately formed on the cartridge 11 and the like mounted in the cartridge holder 12 by a known method (e.g., mechanical method of a contact type, or a method of a non-contact type using a magnetic and optical method). Based on a detection result of the cartridge sensor 64, the CPU 74 acquires type information about the cartridge 11 (details will be described below, refer to FIG. 7).

Feature of Embodiment

According to the above described configuration, the present embodiment features, based on the detection result of the above described cartridge sensor 64, display of the tape color information about the above described cover film and the ink color information about the above described ink ribbon in the cartridge 11. Details will be sequentially described below.

Cartridge Sensor and Cartridge Correlation

According to the present embodiment, the above described cartridge sensor 64 is a mechanical method of a contact type. In other words, on an inner bottom face of the cartridge holder 12, a plurality of (according to this example, five) projections S1, S2, S3, S4, S5 (refer to FIG. 7) to be pressed that constitute the cartridge sensor 64 is formed. Corresponding to the projections, on at least one point on a lower face of the cartridge 11, a projection insertion hole portion (not illustrated) as the above described portion to be detected, is disposed. A point where the above described projection insertion hole portion cannot be disposed is formed in a state of a wall face (no hole). When the cartridge 11 is inserted into the cartridge holder 12, at the point where the above described projection insertion hole portion is disposed, any of the sensor projections S1-S5 is inserted (the projection is not pressed), and then a signal "1" corresponding to the inserted projection is output from the corresponding sensor projection of the sensor projections S1-S5 to be input to the CPU 74. Further, at the point in the above described state of the wall face having the no above described projection insertion hole portion (hole), any of the sensor projections S1-S5 is abutted to be pressed, and then signal "0" corresponding to the pressed projection is output from the corresponding sensor projection of the sensor projections S1-S5, to be input to the CPU 74.

At this point, according to a combination pattern of the above described signal "0" and "1" corresponding to the sensor projections S1-S5, the type information about the cartridge 11 can be acquired. Further, at this point, in the above described EEPROM 77, the above described type information about the cartridge 11, and combinations of the tape color information (corresponding to first color information) about the above described cover film, and the ink color information (corresponding to second color information) about the above described ink ribbon in the cartridge 11 are associated with each other together with tape materials and width dimensions as the cartridge correlation, and stored.

FIG. 7 illustrates the cartridge correlation as a specific example. As illustrated in FIG. 7, for example, when the cartridge 11 is mounted that outputs the detection signal "1" (hole) detected with the sensor projections S1, S5 and outputs the detection signal "0" (no hole) detected with the sensor projections S2, S3, S4, the CPU 74 acquires the tape color information about the cover film "white" and the ink color information about the ink ribbon "black". According to this example, tape type information (e.g., regular tape, hard adhesive tape, cloth tape, acid-free tape) about the above described base tape is also associated as the cartridge correlation. According to this example, the CPU 74 acquires "type A" (e.g., regular tape).

In a similar manner, when the cartridge 11 is mounted that outputs the detection signal "1" (hole) detected with the sensor projections S1, S3, S5 and outputs the detection signal "0" (no hole) detected with the sensor projections S2, S4, the CPU 74 acquires the above described tape color information "black", the above described ink color information "white", and the above described tape type information "type B" (e.g., hard adhesive tape).

Further, in a similar manner, when the cartridge 11 is mounted that outputs the detection signal "1" (hole) detected with the sensor projection S4, and outputs the detection signal "0" (no hole) detected with the sensor projections S1, S2, S3, S5, the CPU 74 acquires the above described tape color information "white", the above described ink color information "red", and the above described tape type information "type C" (e.g., cloth tape).

Further, in a similar manner, when the cartridge 11 is mounted that output the detection signal "1" (hole) detected with the sensor projections S2, S4, S5, and outputs the detection signal "0" (no hole)" detected with the sensor projections S1, S3, the CPU 74 acquires the above described tape color information "yellow", the above described ink color information "black", and the above described tape type information "type D" (e.g., acid-free tape).

As described above, based on the combination pattern between the signals "0" and "1" output from the sensor projections S1, S2, S3, S4, S5 with reference to the above described cartridge correlation, the CPU 74 acquires the above described corresponding tape color information and the above described ink color information. The acquired above described tape color information and ink color information are displayed in text on the liquid crystal display unit 4.

Display Example of Table Color Information and Ink Color Information

Figure 8A:
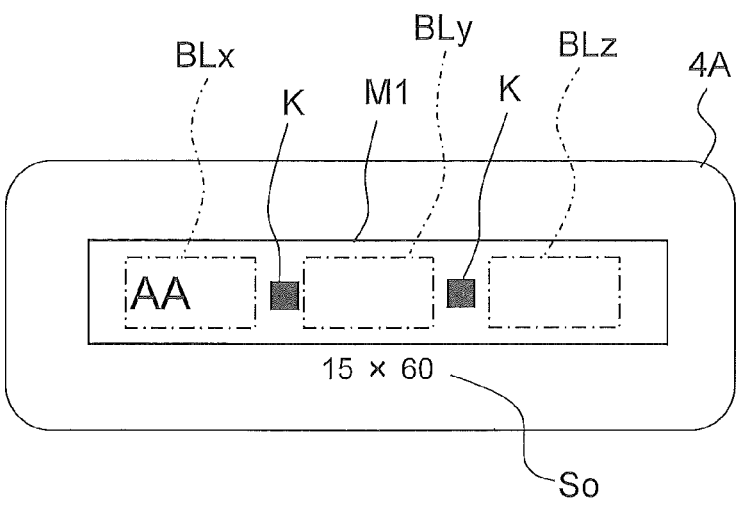
FIG. 8A is an illustration showing a transition of a screen until a liquid crystal display unit displays tape color information and ink color information.
Figure 8B:
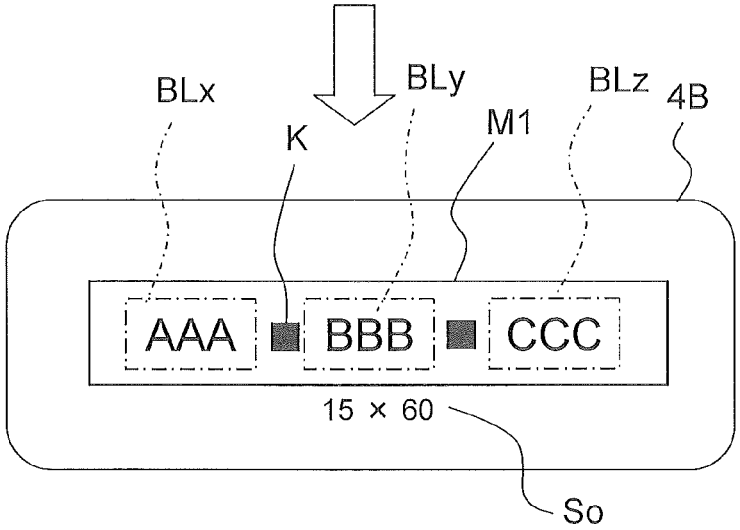
FIG. 8B is an illustration showing a transition of a screen until a liquid crystal display unit displays tape color information and ink color information.
Figure 8C:
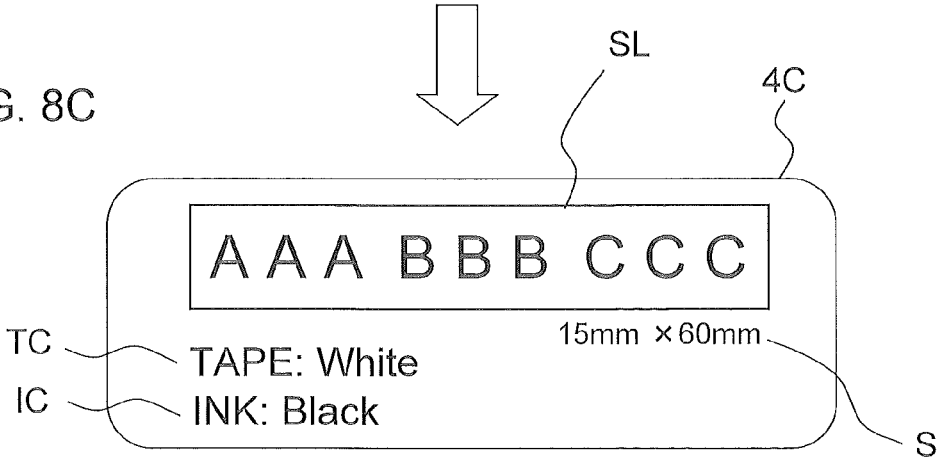
FIG. 8C is an illustration showing a transition of a screen until a liquid crystal display unit displays tape color information and ink color information.

With reference to FIGS. 8A-8C, the example of the above described tape color information and ink color information displayed on the liquid crystal display unit 4 will be described. According to this example, on a preview screen (described below) displayed after an input operation is performed on a so-called edition screen, the above described tape color information and ink color information are displayed in text.

More specifically, as illustrated in FIG. 8A, with an edition initial setting screen (not illustrated) displayed on the liquid crystal display unit 4, the operator performs the input operation of the print object to be arranged on a predetermined number of blocks (according to this example, three of BLx, BLy, BLz) via the keyboard unit 5. According to this example, a character string "AAA" is input for a first block BLx. In this stage, a setting image M1 related to one print label including the character string "AAA" for the block BLx is created and displayed in monochrome as an edition screen 4A after the above described input operation has been performed.

As illustrated in FIG. 8B, a character string "BBB" is input for a subsequent block BLy, and then a character string "CCC" is input for a further subsequent block BLz. As a result, the setting image M1 is created that is related to one print label including the character strings "AAA", "BBB", "CCC" respectively for the blocks BLx, BLy, BLz, and displayed in monochrome as an edition screen 4B.

Between the blocks BLx and BLy, and between the blocks BLy and BLz, a break block mark "K" is displayed. Further, according to this example, dimensional information So informing that a width of the print label is 15 mm and a length thereof is 60 mm is also displayed on the edition screen 4B.

As described above on the edition screen 4B, with the setting image M1 of the above described print label displayed, when the operator appropriately performs a preview operation via the keyboard unit 5, as illustrated in FIG. 8C, on a preview screen 4C, an image SL of the print label including a character string "AAABBBCCC" corresponding to the setting image M1 which is the above described edition result is displayed in monochrome. In the image SL, a character string portion is displayed as a dot display portion (i.e., typically black image portion), and a blank region other than the character string portion is displayed as a non-dot display portion (i.e., typically white image portion).

According to the present embodiment, triggered by the above described preview operation, the above described cartridge sensor 64 performs the detection, and with reference to the above described cartridge correlation on the detection result, the above described tape color information TC and the above described ink color information IC can be acquired. As illustrated in FIG. 8C, the acquired tape color information TC (according to this example, "TAPE: White" representing white) and ink color information IC (according to this example, "INK: Black" representing black) are displayed in text in monochrome at a lower portion of the above described image SL on the preview screen 4C. On the preview screen 4C, also, in a similar manner to the above described edition screen 4B, the dimensional information "S" informing that the width of the print label is 15 mm and the length thereof is 60 mm is displayed.

Control Step

To realize the above described method, the control step executed by the CPU 74 of the label producing apparatus 1 will be described with reference to the flowchart in FIGS. 9 and 10.

Figure 9:
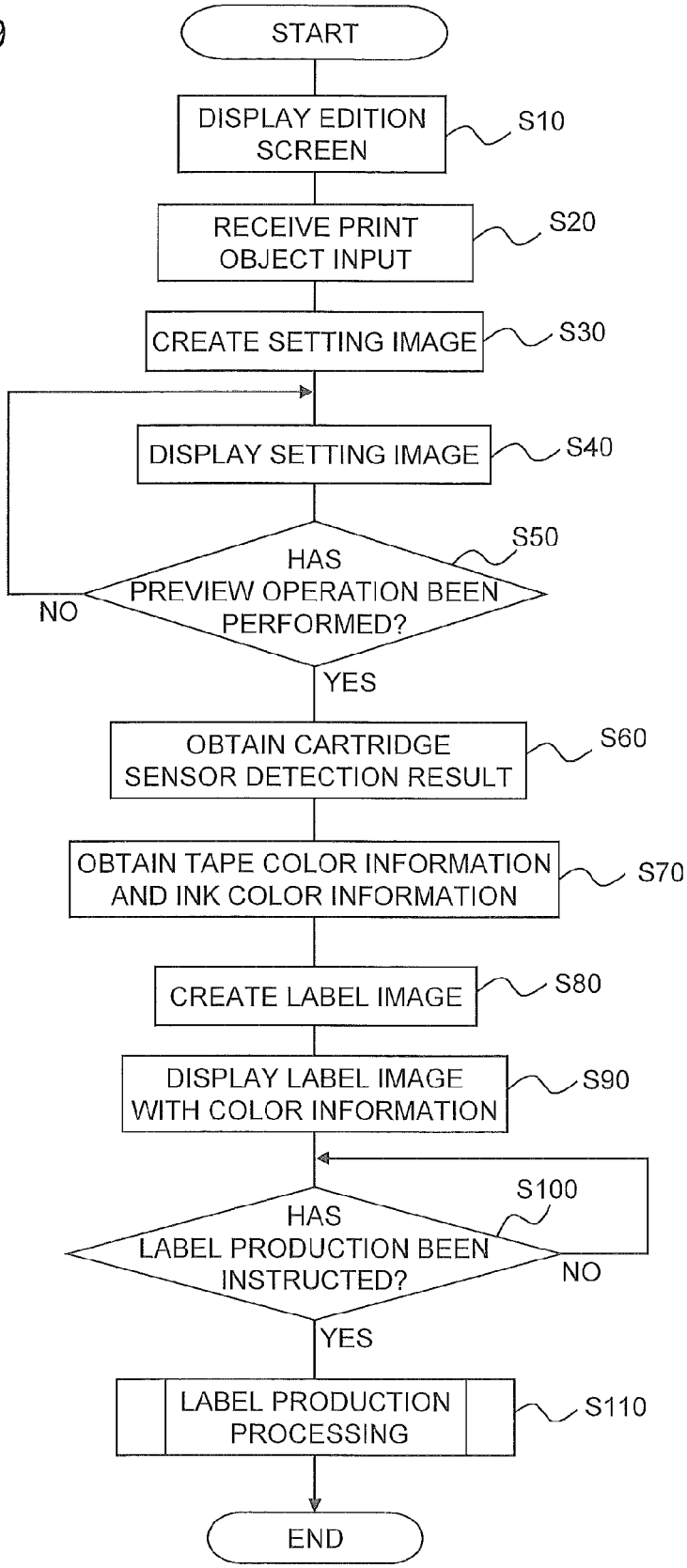
FIG. 9 is a flowchart illustrating control steps executed by a CPU.

As illustrated in FIG. 9, processing illustrated in the flow is started when, for example, a power source of the label producing apparatus 1 is turned on.

In step S10, the CPU 74 outputs the control signal to the liquid crystal display unit 4 to display the above described edition initial setting screen, and processing proceeds to step S20.

In step S20, the CPU 74 receives in text via the keyboard unit 5 the input operation of the print object including the character strings (according to the above described example, text characters of "AAA", "BBB", "CCC" respectively corresponding to three blocks of BLx, BLy, BLz) disposed for a predetermined number of blocks (according to the above described example, three blocks BLx, BLy, BLz).

Thereafter, in step S30, the CPU 74 creates the one above described setting image M1 in which the blocks including the print object received in the above described step S20 are arranged in a tape length direction, and the processing proceeds to step S40.

In step S40, the CPU 74 outputs the control signal to the liquid crystal display unit 4 to display the setting image M1 created in the above described step S30 on the above described edition screen 4A or edition screen 4B (refer to the above described FIGS. 8A, 8B). The CPU 74 executing the above described step S10 and step S40 functions as a first display control portion according to each claim.

Thereafter, in step S50, the CPU 74 determines whether or not the operator has performed the above described preview operation via the keyboard unit 5. When the preview operation has not been performed, the determination in step S50 is not satisfied (NO, step S50), and thus the processing returns to step S40 to repeatedly perform the same steps. When the preview operation has been performed, the determination in step S50 is satisfied (YES, in step S50), and the processing proceeds to step S60.

In step S60, the CPU 74 acquires the detection result by the above described cartridge sensor 64 on the cartridge 11 mounted in the cartridge holder 12.

In step S70, based on the detection result of the above described cartridge sensor 64, with reference to the above described cartridge correlation (refer to FIG. 7) stored in the EEPROM 77, the CPU 74 acquires the corresponding tape color information and ink color information. The CPU 74 executing step S70 functions as a color information acquisition portion according to each claim.

Thereafter, in step S80, the CPU 74 creates the image SL corresponding to the above described setting image M1 created in the above described step S30, and then the processing proceeds to step S90.

In step S90, the CPU 74 outputs the control signal to the liquid crystal display unit 4, and displays the image SL created in the above described step S80 on the above described preview screen 4C with the color information acquired in the above described step S70 (the above described tape color information TC and ink color information IC) (refer to FIG. 8C). The CPU 74 executing step S90 functions as a second display control portion according to each claim. Further, the CPU 74 executing step S90, and the above described step S10 and the above described step S40 functions as the control portion according to each claim.

Then, in step S100, the CPU 74 determines whether or not the operator has input a predetermined label production instruction via the keyboard unit 5. When the label production instruction has not been input, the determination in step S100 is not satisfied (NO, S100), and thus the processing waits in loop. When the label production instruction has been input, the determination in the step S100 is satisfied (YES, S100), and then the processing proceeds to step S110.

In step S110, the CPU 74 creates the print label corresponding to the image SL displayed as a preview in the above described step S90, and then the processing illustrated in this flow is ended.

Details are not described, however, in any display stage described above, for example, by pressing an escape key [Esc] on the keyboard unit 5, subsequent processing of the stage in the flow illustrated in FIG. 9 is stopped to end the flow.

Detailed steps of the label production processing in the above described step S110 will be described with reference to FIG. 10.

Figure 10:
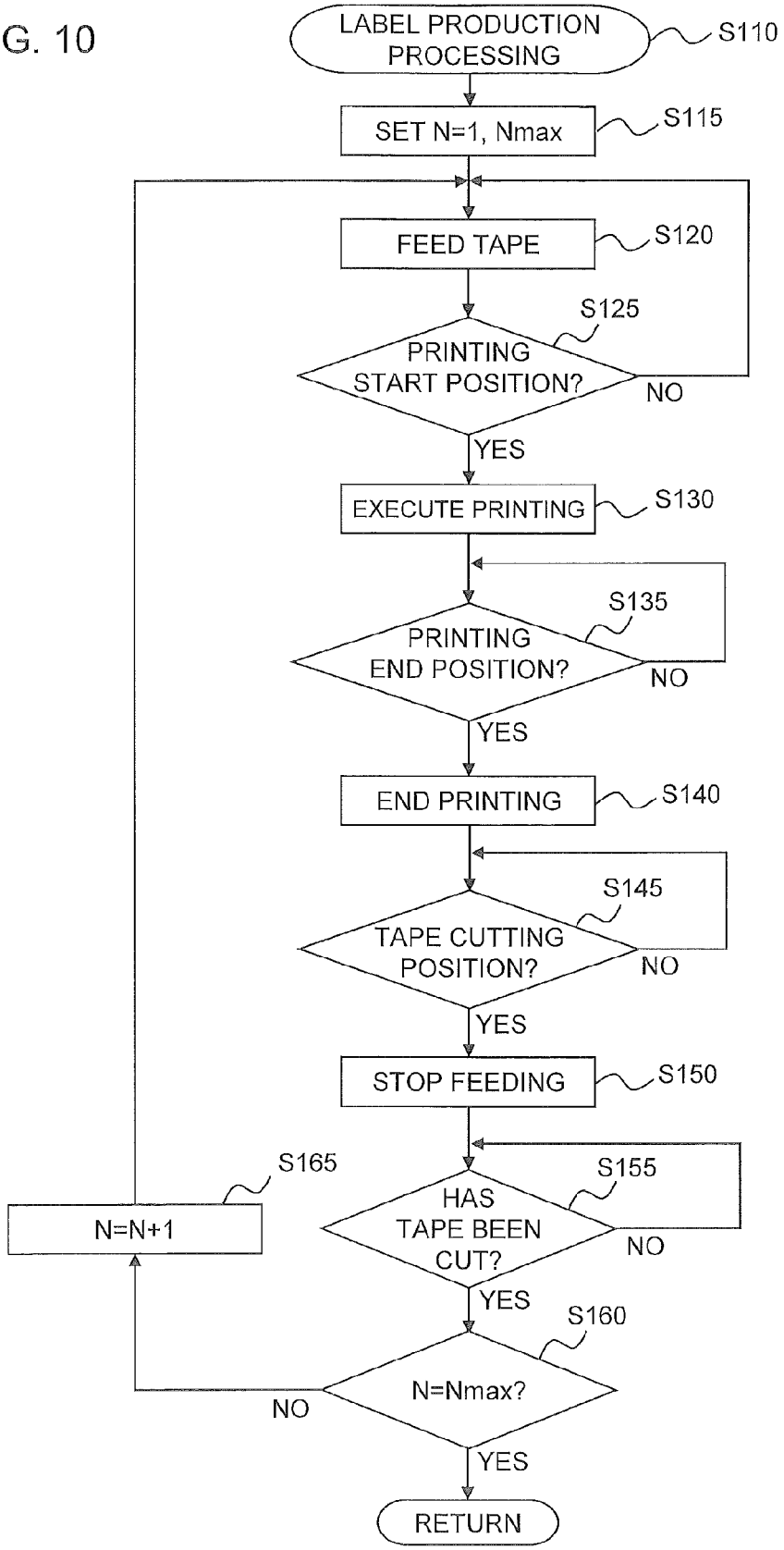
FIG. 10 is a flowchart illustrating detailed steps in step S110.

As illustrated in FIG. 10, first in step S115, the CPU 74 sets to "1" a value of a variable "N" related to the number of print labels to be produced. Further, based on an operator's appropriate operation (input operation of the number of the print labels to be produced) via the keyboard unit 5, the above described variable "N" is set to a maximum value Nmax.

Thereafter, in step S120, the CPU 74 outputs the control signal to the motor driving circuit 63 to start driving the motor 63*a*. With this operation, the gear is rotated and driven, the platen roller 24 and the pressing roller 26 are started to rotate to accordingly start feeding the cover film, the base tape, and the label tape with print (hereinafter, appropriately, simply referred to "cover film and the like").

In step S125, the CPU 74 determines by a known method whether or not positions of the cover film and the like in a feeding direction have reached predetermined printing start positions. Until they reach the printing start positions, a determination in step S125 is not satisfied (NO, S125), and thus the processing returns to the above described step S120 to repeatedly perform the same steps. When they have reached the printing start position, the determination in step S125 is satisfied (YES, S125), and then the processing proceeds to step S130.

In step S130, the CPU 74 outputs to the thermal head driving circuit 61 the control signal (the above described print data corresponding to the above described image SL) corresponding to the label in sequence corresponding to the value of the variable "N" at this time point. With this operation, the thermal head 23 is driven corresponding to the print data, the print object (according to the above described example, the character string) corresponding to the print data is started to be formed on the cover film.

Then, in step S135, the CPU 74 determines by a known method whether or not the positions of the cover film and the like in a feeding direction have reached a predetermined printing end position. Until they reach the printing end position, the determination in step S135 is not satisfied (NO, S135), and thus the processing waits in a loop. When they have reached the printing end position, the determination in step S135 is satisfied (YES, S135), and then the processing proceeds to step S140.

In step S140, the CPU 74 outputs the control signal to the thermal head driving circuit 61 to stop driving the thermal head 23 so as to end the above described printing.

Thereafter, in step S145, the CPU 74 determines by the known method whether or not a position of the above described label tape with print in the feeding direction has reached a tape cutting position. Until it reaches the tape cutting position, the determination in step S145 is not satisfied (NO, S145), and thus the processing waits in a loop. When it has reached the tape cutting position, the determination in step S145 is satisfied (YES, S145), and then the processing proceeds to step S150.

In step S150, the CPU 74 outputs the control signal to the motor driving circuit 63 to stop driving the motor 63*a*. This stops the rotation of the platen roller 24, the pressing roller 26 and the like to stop feeding the cover film, the base tape, and the label tape with print.

Then, in step S155, the CPU 74 determines whether or not the cutting operation lever 6 has been operated to drive the cutter to cut the above described label tape with print. Until the label tape with print has been cut, a determination in step S155 is not satisfied (NO, S155), and thus the processing waits in a loop. When the label tape with print has been cut, the determination in step S155 is satisfied (YES, S155), and then the processing proceeds to step S160. When the label tape with print has been cut, the print label "L" in sequence corresponding to the value of the variable "N" at this point is created.

In step S160, the CPU 74 determines whether or not the value of the variable "N" has reached the above described maximum value Nmax. Until the value of the variable "N" reaches the maximum value Nmax, a determination in step S160 is not satisfied (NO, S160), and then the processing proceeds to step S165. In step S165, after the CPU 74 adds "1" to the value of the variable "N", the processing returns to the above described step S120 to repeatedly perform the same steps. On the other hand, in step S160, when the value of the variable "N" has reached the maximum value Nmax, the determination in step S160 is satisfied (YES, S160), and then the routine is ended. With the above described steps, all pieces of the print labels desired by the operator are created.

The present disclosure is not limited to the above described embodiments, however, various modifications and alterations of the disclosure may be made without departing from the spirit and the technical idea of the disclosure. The modification examples will be described in sequence below. A same reference symbol is applied to a portion equivalent to that of the above described embodiment and, appropriately, it will not be repeatedly described or will be simplified.

(1) When Tape Color Information and Ink Color Information are Displayed on Edition Screen According to the present modification example, unlike the above described embodiment, the tape color information and the ink color information are displayed on the above described edition screens 4A, 4B.

Figure 11A:
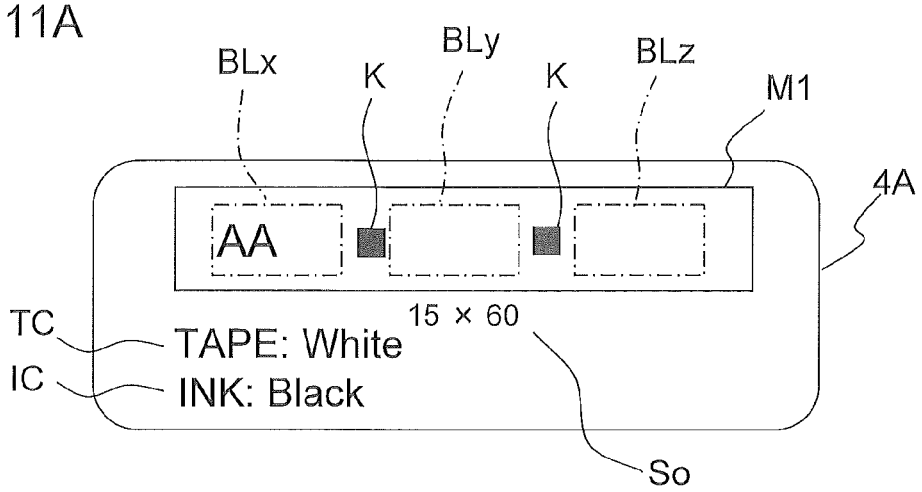
FIG. 11A is an illustration showing a transition of the screen until the liquid crystal display unit displays the tape color information and the ink color information according to a modification example in which an edition screen displays the tape color information and the ink color information.

More specifically, as illustrated in FIG. 11A corresponding to the above described FIG. 8A, with the edition initial setting screen (not illustrated) displayed on the liquid crystal display unit 4, the operator performs the input operation of the print object to be arranged for a predetermined number of blocks (according to this example, three blocks of BLx, BLy, BLz) via the keyboard unit 5. According to this example, the character string "AAA" is input for the first block BLx.

According to the present modification example, triggered by the display of the above described edition initial setting screen and subsequently the edition screens 4A, 4B on the above described liquid crystal display unit 4, the detection is performed by the above described cartridge sensor 64, and further the above described cartridge correlation is referred to on the detection result, so that the above described tape color information TC and the above described ink color information IC can be acquired. As illustrated in FIG. 11A, the acquired tape color information TC (according to this example, "TAPE: White" representing white) and the ink color information IC (according to this example, "INK: Black" representing black) are displayed in monochrome text at a lower portion of the above described setting image M1 on the edition screen 4A.

Figure 11B:
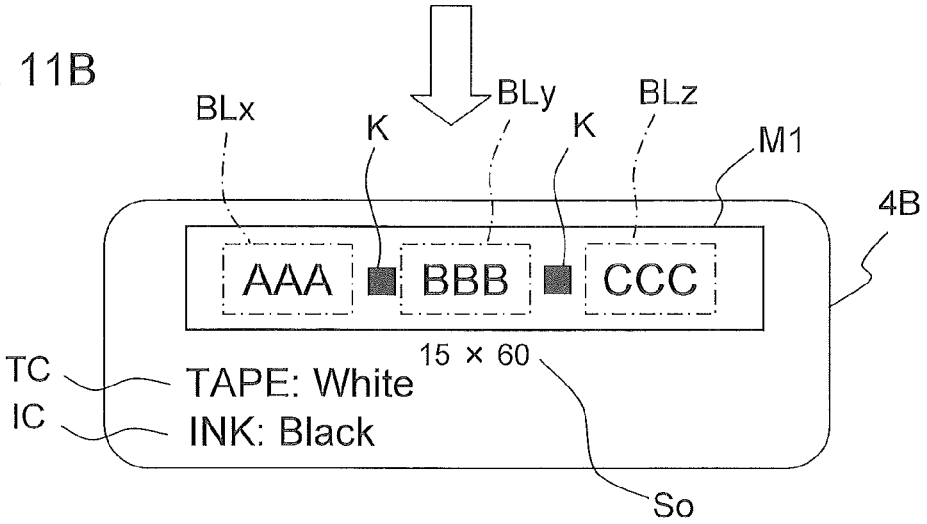
FIG. 11B is an illustration showing a transition of the screen until the liquid crystal display unit displays the tape color information and the ink color information according to a modification example in which an edition screen displays the tape color information and the ink color information.

Subsequently, as illustrated in FIG. 11B in a similar manner to the above described FIG. 8B, based on the input for the blocks BLy, BLz, the above described setting image M1 including the character strings "AAA", "BBB", "CCC" respectively for the blocks BLx, BLy, BLz is created, and then displayed as the edition screen 4B. As described above, following the above described edition screen 4A, on the edition screen 4B also, the above described tape color information TC and ink color information IC are displayed in text.

Figure 11C:
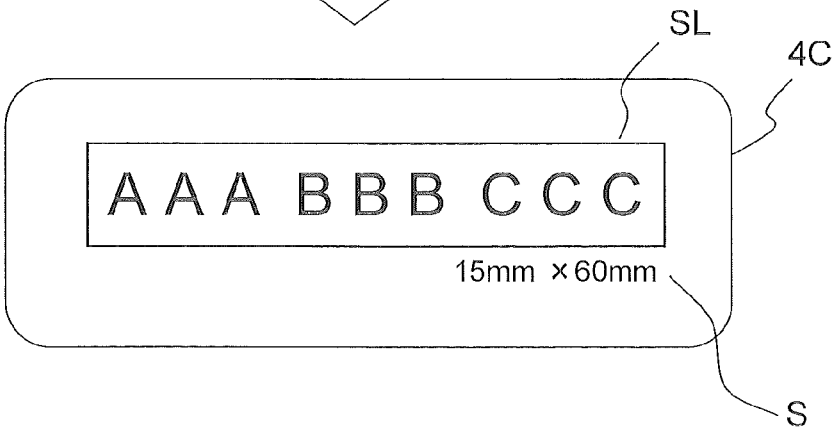
FIG. 11C is an illustration showing a transition of the screen until the liquid crystal display unit displays the tape color information and the ink color information according to a modification example in which an edition screen displays the tape color information and the ink color information.

With the setting image M1 on the above described edition screen 4B being displayed, the operator performs the above described preview operation to display the preview screen 4C, as illustrated in FIG. 11C in a similar manner to the above described FIG. 8C. On the preview screen 4C, as described above, the image SL of the print label including the character string "AAABBBCCC" corresponding to the above described setting image M1 is displayed in monochrome. According to the present modification example, unlike the above described embodiment, on this preview screen 4C, the above described tape color information TC and ink color information IC are not displayed (however, may be displayed).

Figure 12:
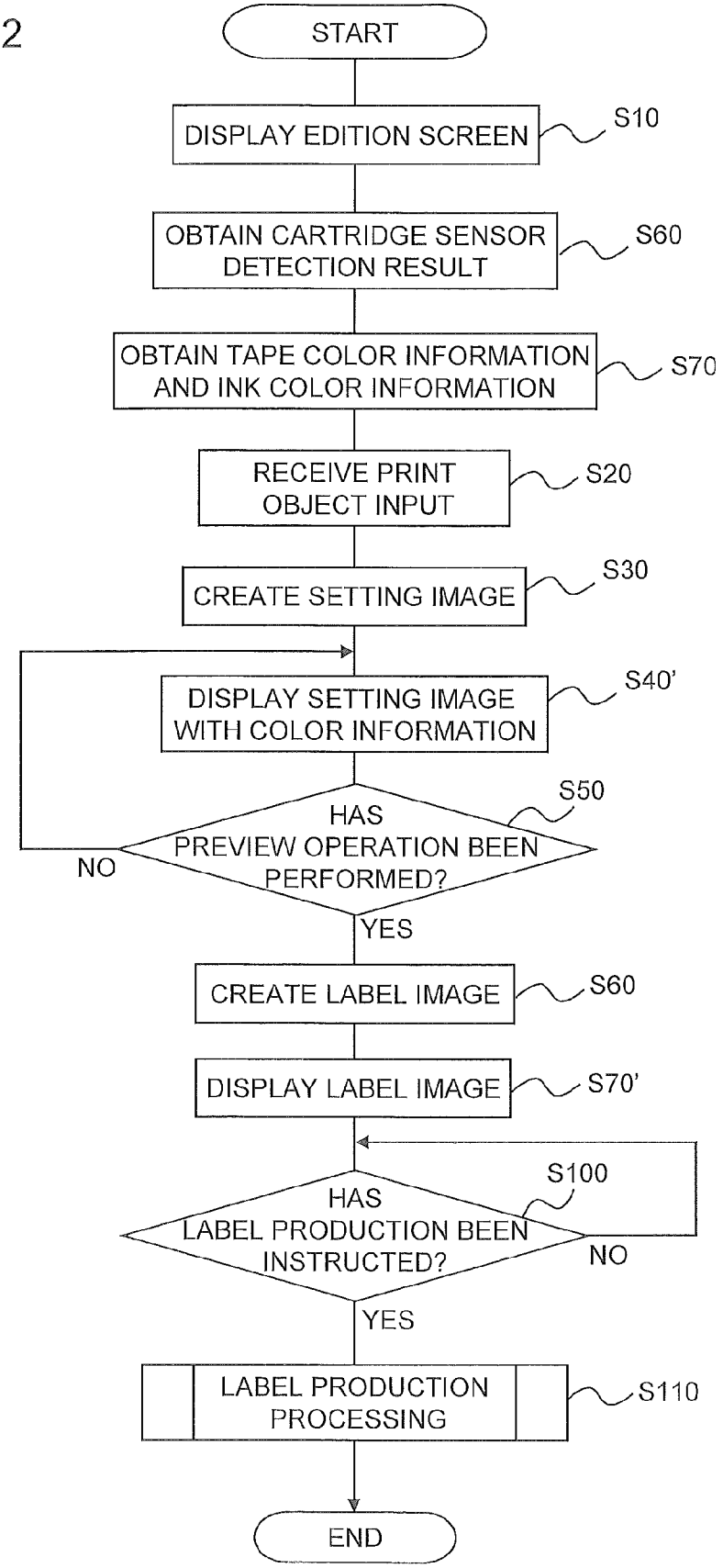
FIG. 12 is a flowchart illustrating the control steps executed by the CPU.

FIG. 12 illustrates control steps executed by the CPU 74 according to the above described modification example. The flow illustrated in FIG. 12 differs from that of the above described FIG. 9 in that step S60 and step S70 are moved to and arranged between step S10 and step S20, and in place of step S40 and step S90, step S40' and step S70' are disposed.

In other words, in FIG. 12, when step S10 in a similar manner to the above described FIG. 9 is ended, the processing proceeds to step S60 that is newly moved.

In step S60, in a similar manner to the above described FIG. 9, the CPU 74 acquires the detection result by the above described cartridge sensor 64 on the cartridge 11 mounted in the cartridge holder 12. Subsequently, in step S70, in a similar manner to the above described FIG. 8, based on the detection result of the above described cartridge sensor 64, with reference to the above described cartridge correlation, the CPU 74 acquires the corresponding tape color information and ink color information. The CPU 74 executing step S70 functions as a color information acquisition portion according to each claim.

Subsequent steps S20 and step S30 are the same as those in the above described FIG. 9 and, the CPU 74, after receiving the text input operation of the print object to be arranged for the blocks BLx, BLy, BLz, creates the corresponding above described setting image M1. Subsequently, the processing proceeds to step S40' that is newly disposed.

In step S40', the CPU 74 outputs the control signal to the liquid crystal display unit 4, and causes the above described edition screen 4A or edition screen 4B to display the setting image M1 created in the above described step S30 together with the color information (the above described tape color information TC and ink color information IC) acquired in the above described step S70 (refer to the above described FIGS. 11A, 11B). The CPU 74 executing the above described step S10 and step S40' functions as a first display control portion according to each claim.

Subsequent steps S50, S60 are the same as those in the above described FIG. 8 and, when the operator performs the preview operation, the image SL corresponding to the above described setting image M1 created in the above described step S30 is created. Subsequently, the processing proceeds to step S70' that is newly disposed.

In step S70', the CPU 74 outputs the control signal to the liquid crystal display unit 4 to display the image SL (without including the above described tape color information TC and ink color information IC) created in the above described step S60 on the above described preview screen 4C (refer to FIG. 11C). The CPU 74 executing step S70' functions as a second display control portion according to each claim. Further, the CPU 74 executing step S70', the above described step S10, and the above described step S40' function as the control portion according to each claim.

Subsequent steps S100, S110 have processing equivalent to those in the above described FIGS. 9, 10, and thus they are not repeatedly described.

According to the present modification example, in a similar manner to the above described embodiment, for example, by pressing an escape key "Esc" on the keyboard unit 5, the flow can be stopped.

According to the modification example, the above described tape color information TC and ink color information IC are displayed on the edition screens 4A, 4B of the liquid crystal display unit 4.

(2) When Image is Inverted and Displayed Depending on Tape Color and Ink Color

According to the modification example, according to an acquisition result of the above described tape color information and ink color information based on the detection result of the cartridge sensor 64, sorting of the above described dot display portion and the above described non-dot display portion in a monochrome display of the image SL displayed on the above described preview screen 4C is inverted (white and black are inverted).

Figure 13A:
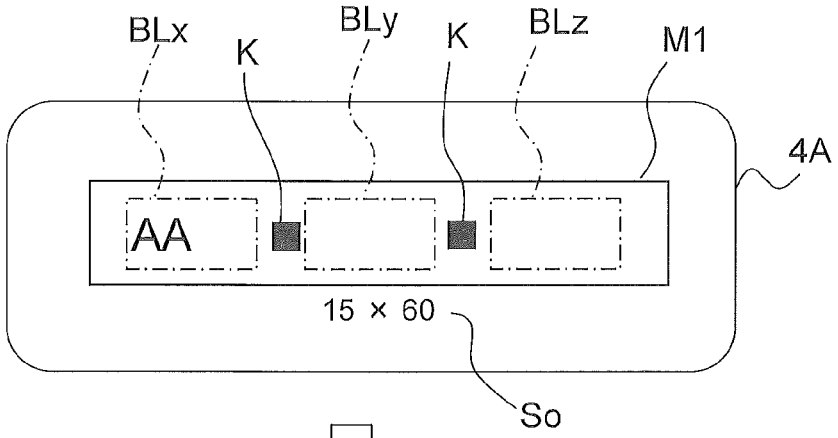
FIG. 13A is an illustration showing a modification example in which an inverted label image is displayed on a preview screen.
Figure 13B:
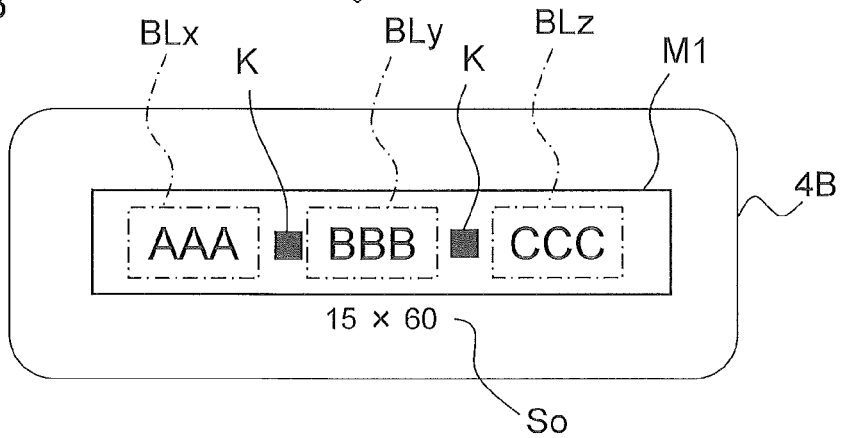
FIG. 13B is an illustration showing a modification example in which an inverted label image is displayed on a preview screen.
Figure 13C:
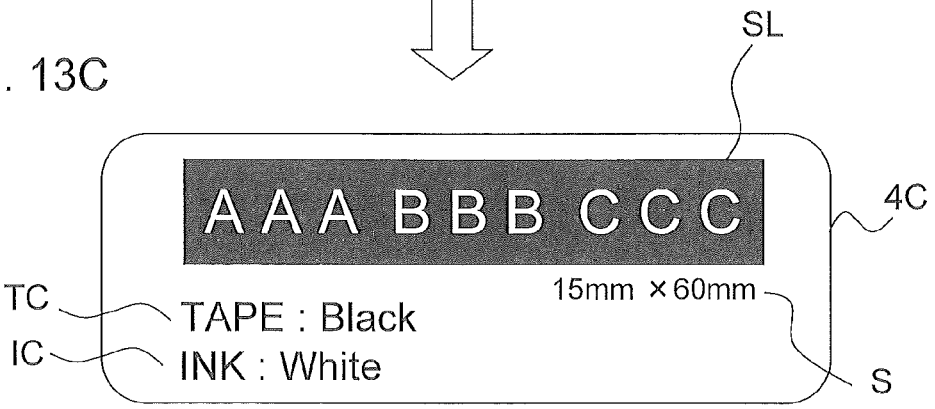
FIG. 13C is an illustration showing a modification example in which an inverted label image is displayed on a preview screen.
Figure 14A:
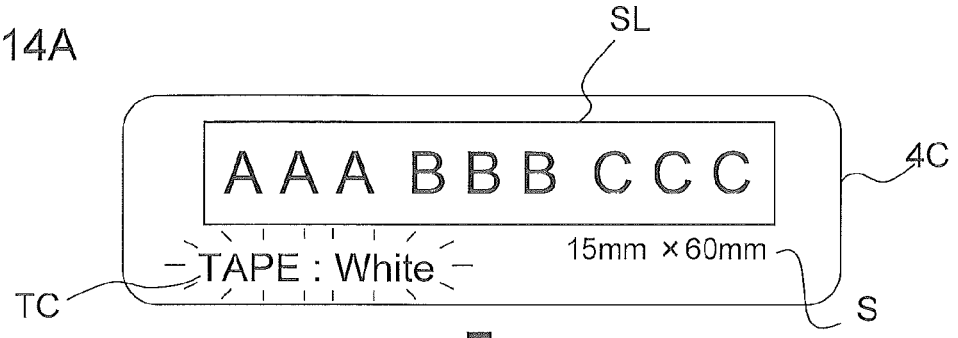
FIG. 14A is an illustration showing a modification example in which the tape color information and the ink color information are switched to each other and alternatingly displayed on the preview screen.
Figure 14B:
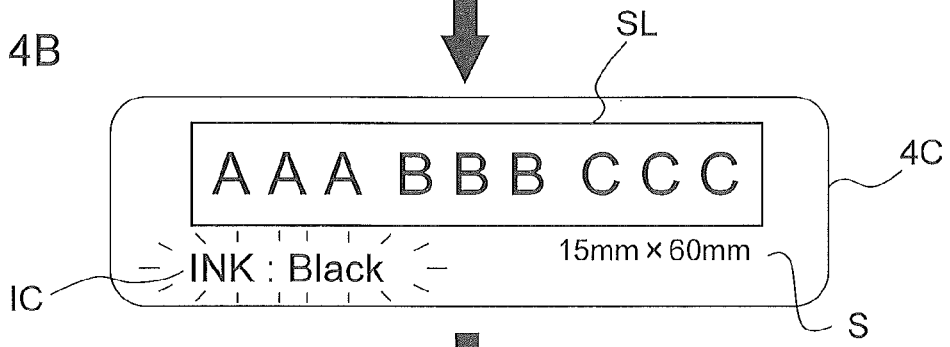
FIG. 14B is an illustration showing a modification example in which the tape color information and the ink color information are switched to each other and alternatingly displayed on the preview screen.
Figure 14C:
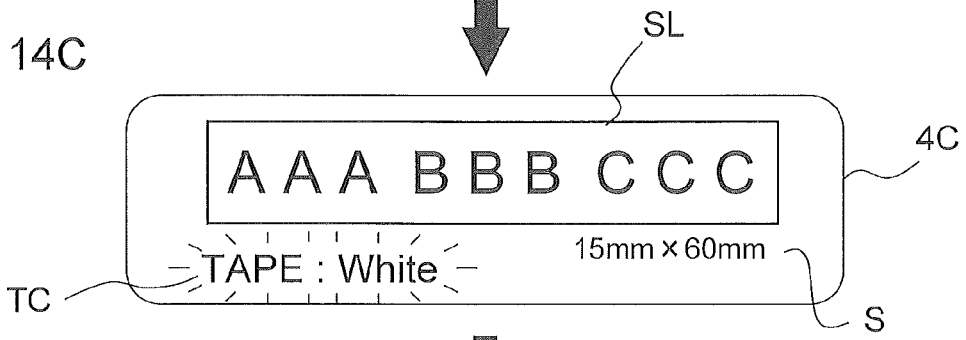
FIG. 14C is an illustration showing a modification example in which the tape color information and the ink color information are switched to each other and alternatingly displayed on the preview screen.
Figure 14D:
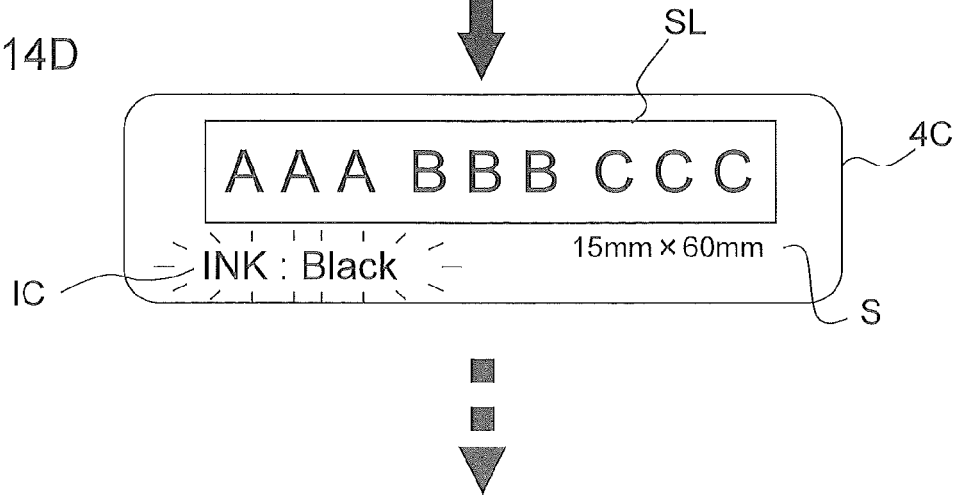
FIG. 14D is an illustration showing a modification example in which the tape color information and the ink color information are switched to each other and alternatingly displayed on the preview screen.

More specifically, as illustrated in FIG. 13C of FIGS. 13A-13C corresponding to each of the above described FIGS. 8A-8C, for example, when the acquired above described tape color information of the cover film is comparatively dark color (according to this example, black) and further the above described ink color information about the ink ribbon is comparatively light color (according to this example, white), a portion of a tape base of the image SL is defined as a dot display portion, and a print data portion of text characters (according to this example, "AAABBBCCC") is defined as a non-dot display portion. In a similar manner to the above described embodiment illustrated in FIG. 8C, the above described acquired tape color information TC ("TAPE: Black" according to the above described example) and ink color information IC ("INK: White" according to the above described example) are displayed at the lower portion of the image SL that is inverted and displayed on the preview screen 4C.

(3) When Tape Color Information and Ink Color Information are Switched and Alternatingly Displayed More specifically, according to the present modification example, as illustrated in FIG. 14, on the preview screen 4C of the liquid crystal display unit 4, when a space at a lower side of the image SL is not sufficiently large, the above described tape color information TC and the above described ink color information IC are temporally switched and alternatingly displayed in a substantially same region.

In other words, according to this example, based on the control by the CPU 74, in the substantially same region at a lower left side of the image SL on the above described preview screen 4C, the tape color information TC and the ink color information IC is temporally switched and alternatingly displayed, for example, the tape color information TC ("TAPE: White") illustrated in FIG. 14A to the ink color information IC ("INK: Black") illustrated in FIG. 14B to the tape color information TC ("TAPE: White") illustrated in FIG. 14C to the ink color information IC ("INK: Black") illustrated in FIG. 14D to the subsequent tape color information TC and the ink color information IC.

(4) When Display Region of Dimensional Information is Used to Display Ink Color and Tape Information For example, as described above, when the size of the above described liquid crystal display unit 4 is not sufficiently large, at the lower left side of the image SL, for example, only the tape color information TC may be displayed at the lower left side thereof, and the ink color information IC may be displayed in a region at a lower right side of the image SL used to display the above described dimensional information "S". To the contrary, for example, the ink color information IC may be displayed at the lower left side of the image SL and the tape color information TC may be displayed in the region at the lower right side thereof to be used to display the above described dimensional information "S".

(5) Others

Further, timing for displaying the above described ink color information IC and the tape color information TC is not limited to when the above described preview screen 4C is displayed and when the edition screens 4A, 4B are displayed. More specifically, in association with timing when the cover 3 is mounted to cover the label production unit 10 and the battery storage unit 30 of the apparatus main body 2 from a state where the cover 3 is removed (when the detection device or the like appropriately detects a state of covering), the detection may be performed by the above described cartridge sensor 64 and the ink color information IC and the tape color information TC may be displayed.

Arrows illustrated in the above described FIG. 6 indicate an example of flows of signals and do not limit flow directions of the signals.

Further, the flowcharts illustrated in FIGS. 9, 10, 12 do not limit to the steps illustrating the present disclosure, but, steps may be added, deleted, or orders may be changed within a range not departing from the spirit and the technical idea of the disclosure.

Further, in addition to the methods described above, the methods according to the above described embodiments may be appropriately combined and used.

Furthermore, each example is not described in detail, but, the present disclosure is conducted with various changes added, within a range not departing from the spirit and the technical idea of the disclosure.

What is claimed is:

1. A printer comprising:

a housing forming an apparatus outer enclosure;

a cartridge holder disposed inside said housing and configured to removably mount a tape cartridge including a print-receiving tape roll feeding out a print-receiving tape and an ink ribbon roll feeding out an ink ribbon;

a display device disposed on said housing and configured to display desired content in monochrome;

an opening and closing cover disposed on said housing and configured to open and close said cartridge holder;

a thermal head configured to form print data by transferring ink of said ink ribbon fed out from said ink ribbon roll to said print-receiving tape fed out from said print-receiving tape roll of said tape cartridge mounted in said cartridge holder, to produce print tape;

a color detection portion configured to detect first color information representing a color of said print-receiving tape and second color information representing a color of said ink ribbon, in said tape cartridge mounted in said cartridge holder; and a control portion configured to control said display device at appropriate timing with said opening and closing cover closed, to display in text said first color information and said second color information detected by said color detection portion.

2. The printer according to claim 1, further comprising a memory configured to store cartridge correlation in which type information about said tape cartridge and combination of said first color information about said print-receiving tape and said second color information about said ink ribbon in the tape cartridge are associated with each other, wherein said color detection portion includes:

a cartridge sensor configured to detect said type information about said tape cartridge mounted in said cartridge holder; and a color information acquisition portion configured to acquire corresponding said first color information and said second color information, with reference to said cartridge correlation stored in said memory with respect to a detection result of said cartridge sensor.

3. The printer according to claim 1, further comprising an operation device disposed on said housing and configured to execute a desired operation, wherein said control portion includes:

a first display control portion configured to control said display device to display in monochrome an edition screen for receiving an operation input of said print data via said operation device; and a second display control portion configured to control said display device to display in monochrome a preview screen for displaying an image of said print tape corresponding to a result of said operation input on said edition screen; and said second display control portion controls said display device to display in text said first color information and said second color information on said preview screen.

4. The printer according to claim 3, wherein said second display portion controls said display device according to a detection result of said color detection portion, to invert sorting of a dot display portion and a non-dot display portion in the display in monochrome of said image displayed on said preview screen.

5. The printer according to claim 1, further comprising an operation device disposed on said housing and configured to execute a desired operation, wherein said control portion includes:

a first display control portion configured to control said display device to display in monochrome an edition screen for receiving an operation input of said print data via said operation device; and a second display control portion configured to control said display device to display in monochrome a preview screen for displaying an image of said print tape corresponding to a result of said operation input on said edition screen; and said first display control portion controls said display device to display in text said first color information and said second color information on said edition screen.

6. The printer according to claim 1, wherein said control portion controls said display device to temporally switch between said first color information and said second color information and alternately display said first color information and said second color information in a substantially same region of said display device.

7. A non-transitory computer-readable recording medium, storing a control program for executing steps on a computing device of a printer that includes a housing forming an apparatus outer enclosure; a cartridge holder disposed inside said housing and configured to removably mount, a tape cartridge including a print-receiving tape roll feeding out a print-receiving tape and an ink ribbon roll feeding out an ink ribbon; a display device disposed on said housing and configured to display desired content in monochrome; an opening and closing cover disposed on said housing and configured to open and close said cartridge holder; a thermal head configured to form print data by transferring ink of said ink ribbon fed out from said ink ribbon roll to said print-receiving tape fed out from said print-receiving tape roll of said tape cartridge mounted in said cartridge holder, to produce print tape; and an operation device disposed on said housing and configured to execute a desired operation, said steps comprising:

a color detection step for detecting first color information representing a color of said print-receiving tape and second color information representing a color of said ink ribbon in said tape cartridge mounted in said cartridge holder;

a first display control step for controlling said display device at appropriate timing with said opening and closing cover closed to display in monochrome an edition screen for receiving an operation input of said print data via said operation device; and a second display control step for controlling said display device to display in monochrome a preview screen for displaying an image of said print tape corresponding to a result of the operation input on said edition screen, and also display in text said first color information and said second color information on said preview screen.

8. A non-transitory computer-readable recording medium, storing a control program for executing steps on a computing device of a printer that includes a housing forming an apparatus outer enclosure; a cartridge holder disposed inside said housing and configured to removably mount, a tape cartridge including a print-receiving tape roll feeding out a print-receiving tape and an ink ribbon roll feeding out an ink ribbon; a display device disposed on said housing and configured to display, desired content in monochrome; an opening and closing cover disposed on said housing and configured to open and close said cartridge holder; a thermal head configured to form print data by transferring ink of said ink ribbon fed out from said ink ribbon roll to said print-receiving tape fed out from said print-receiving tape roll of said tape cartridge mounted in said cartridge holder, to produce print tape; and an operation device disposed on said housing and configured to execute a desired operation, said steps comprising:

a color detection step for detecting first color information representing a color of said print-receiving tape and second color information representing a color of said ink ribbon in said tape cartridge mounted in said cartridge holder;

a third display control step for controlling said display device at appropriate timing with said opening and closing cover closed to display in monochrome an edition screen for receiving an operation input of said print data via said operation device, and also display in text said first color information and said second color information on said edition screen; and a fourth display control step for controlling said display device to display in monochrome a preview screen for displaying an image of said print tape corresponding to a result of the operation input on said edition screen.

* * * * *